US010428582B1

(12) United States Patent
Anderson et al.

(10) Patent No.: US 10,428,582 B1
(45) Date of Patent: Oct. 1, 2019

(54) METHODS AND SYSTEMS OF CREATING PRESSURE PULSES FOR PULSE TELEMETRY FOR MWD TOOLS USING A DIRECT DRIVE HYDRAULIC RAM

(71) Applicant: Standard Directional Services Ltd., Calgary (CA)

(72) Inventors: Desmond Anderson, Calgary (CA); Salvador Berberov, Calgary (CA)

(73) Assignee: Standard Directional Services LTD, Calgary, Alberta (CA)

( * ) Notice: Subject to any disclaimer, the term of this patent is extended or adjusted under 35 U.S.C. 154(b) by 0 days.

(21) Appl. No.: 16/365,923

(22) Filed: Mar. 27, 2019

Related U.S. Application Data

(60) Provisional application No. 62/782,667, filed on Dec. 20, 2018.

(51) Int. Cl.

| | |
|---|---|
| ***E21B 47/18*** | (2012.01) |
| ***E21B 4/02*** | (2006.01) |
| ***E21B 17/20*** | (2006.01) |
| ***E21B 47/06*** | (2012.01) |
| ***E21B 21/08*** | (2006.01) |
| ***E21B 21/10*** | (2006.01) |
| *E21B 34/06* | (2006.01) |

(52) U.S. Cl.
CPC ..... *E21B 4/02* (2013.01); *E21B 17/20* (2013.01); *E21B 21/08* (2013.01); *E21B 21/10* (2013.01); *E21B 47/06* (2013.01); *E21B 47/187* (2013.01); *E21B 34/06* (2013.01)

(58) Field of Classification Search
CPC ..... E21B 21/10; E21B 47/18; E21B 47/187
USPC ..... 175/57
See application file for complete search history.

(56) References Cited

U.S. PATENT DOCUMENTS

| | | | | |
|---|---|---|---|---|
| 6,016,288 | A | 1/2000 | Frith | |
| 2005/0231383 | A1* | 10/2005 | Pratt | E21B 47/187 340/855.4 |
| 2010/0025111 | A1 | 2/2010 | Gearhart et al. | |

* cited by examiner

*Primary Examiner* — Taras P Bemko
(74) *Attorney, Agent, or Firm* — Dickinson Wright, PLLC; Mark E. Scott; Michael E. Noe

(57) ABSTRACT

Creating pressure pulses for pulse telemetry for MWD tools using direct drive. Example embodiments of creating the pressure pulses include: activating an electric motor and thereby turning a motor shaft; turning a threaded shaft by rotation of the motor shaft; translating a ball screw nut along the threaded shaft responsive to turning the threaded shaft; translating a piston rod within a cylinder housing by the linear positioner responsive to translating the ball screw nut; moving the poppet coupled to the piston rod; counting electronic pulses from a sensor that senses full or partial rotations of the motor shaft, the counting creates a count value; and ceasing activation of the electric motor when the count value meets or exceeds a set point count value proportional to a predetermined travel distance of the poppet.

18 Claims, 9 Drawing Sheets

METHODS AND SYSTEMS OF CREATING PRESSURE PULSES FOR PULSE TELEMETRY FOR MWD TOOLS USING A DIRECT DRIVE HYDRAULIC RAM

CROSS-REFERENCE TO RELATED APPLICATIONS

This application claims the benefit of U.S. Provisional Application Ser. No. 62/782,667 filed Dec. 20, 2018 titled "Magnetic Positioned Sensing Smart Hydraulic Cylinder." The provisional application is incorporated by reference herein as if reproduced in full below.

BACKGROUND

Hydrocarbon drilling operations utilize information relating to parameters and conditions downhole during drilling. Such information may comprise characteristics of the earth formations surrounding the borehole, along with data relating to the size and direction of the borehole itself. The collection of information relating to conditions downhole is termed "logging."

In the early hydrocarbon prospecting, drilling operations and logging operations where separate and distinct operations. Logging a well required removing or "tripping" the drilling assembly to insert a wireline logging tool to collect the data. As drilling technology advanced, aspects of logging tools became part of the drill string, and specifically the bottom hole assembly (BHA), such that data could be collected contemporaneously with the drilling processing.

Systems for measuring conditions downhole, such as the movement and position of the drilling assembly, have come to be known as "measuring-while-drilling" techniques, or "MWD". Similar techniques, concentrating more on the measurement of formation parameters, have come to be known as "logging-while-drilling" techniques, or "LWD". The terms MWD and LWD often are used interchangeably. For purpose of this disclosure, the term MWD will be used with the understanding that this term may encompass both the collection of formation parameters and the collection of information relating to the movement and position of the drilling assembly.

In MWD systems, sensors in the drill string measure drilling parameters and in some cases formation characteristics. While drilling is in progress, data from these sensors is continuously or intermittently transmitted to a surface detector by some form of telemetry. Most MWD systems use the drilling fluid (or mud) in the drill string as the information carrier, and are thus referred to as mud-pulse telemetry systems. In positive-pulse systems, a valve or other form of flow restrictor creates pressure pulses in the fluid flow by adjusting the size of a constriction in the drill string (e.g., positive-pressure system). In negative-pulse systems, a valve creates pressure pulses by releasing fluid from the interior of the drill string to the annulus, bypassing the drilling bit (e.g., negative-pulse systems). In both system types, the pressure pulses propagate at the speed of sound through the drilling fluid to the surface, where they are detected by various types of transducers.

Some related art positive-pulse systems create the positive pulse by actuating a pilot valve, and the pilot valve in turn actuates a main poppet valve to cause a temporary flow restriction and/or blockage and thus an increased pressure pulse. Such systems have reliability issues in that particles in the drilling fluid tend to accumulate in and around the pilot valve, which degrades performance of the pilot valve.

Eventually the particle accumulation in and around the pilot valve disables the pilot valve, and thus disables the ability to create pulses.

SUMMARY

One example embodiment is a method of creating pressure pulses within a drill string during drilling operations, the method comprising moving a poppet of a pulser system within a measuring while drilling (MWD) tool. Moving of the poppet may include: activating, by a motor controller, an electric motor and thereby turning a motor shaft; turning a threaded shaft by rotation of the motor shaft; translating a ball screw nut along the threaded shaft responsive to turning the threaded shaft, the ball screw nut telescoped over the threaded shaft, and the ball screw nut rigidly coupled to a linear positioner; translating a piston rod within a cylinder housing by the linear positioner responsive to translating the ball screw nut; and thereby moving the poppet coupled to the piston rod, the movement of the poppet relative to a valve seat; counting, by the motor controller during the activating, pulses from a sensor that senses full or partial rotations of the motor shaft, the counting creates a pulse count value; and ceasing activation of the electric motor when the pulse count value meets or exceeds a set point pulse count value proportional to a predetermined travel distance of the poppet.

Another example embodiment is a pulser system for a measuring-while-drilling (MWD) tool, the pulser system comprising a poppet assembly, a linear actuator assembly, and an electric drive assembly. The poppet assembly may comprise: a poppet; a piston rod defining a first end and a second end, the first end coupled to the poppet; and a cylinder housing defining an internal diameter, the second end of the piston rod telescoped within the internal diameter of the cylinder housing, and the cylinder housing and second end of the piston rod form a first seal. The linear actuator assembly may comprise: a barrel defining an inside diameter, a first end, and a second end, the first end of the barrel coupled to the cylinder housing; hydraulic fluid within the inside diameter of the barrel between the first seal and a second seal on the second end of the barrel; a linear positioner defining a first end and a second end, the first end of the linear positioner coupled to the second end of the piston rod, and the linear positioner submerged in the hydraulic fluid; a ball screw nut coupled to the second end of the linear positioner and submerged in the hydraulic fluid; a threaded shaft submerged in the hydraulic fluid, the threaded shaft threaded through the ball screw nut; and an electric motor defining a motor shaft and stator windings submerged in the hydraulic fluid, the motor shaft coupled to a connection end of the threaded shaft. The electric drive assembly may comprise: a motor controller electrically coupled to the stator windings; and the motor controller configured to move the poppet relative to the electric motor by selectively activating the motor shaft to turn in either a first direction or a second direction.

BRIEF DESCRIPTION OF THE DRAWINGS

For a detailed description of example embodiments, reference will now be made to the accompanying drawings (not necessarily to scale) in which.

DEFINITIONS

Figure 1:
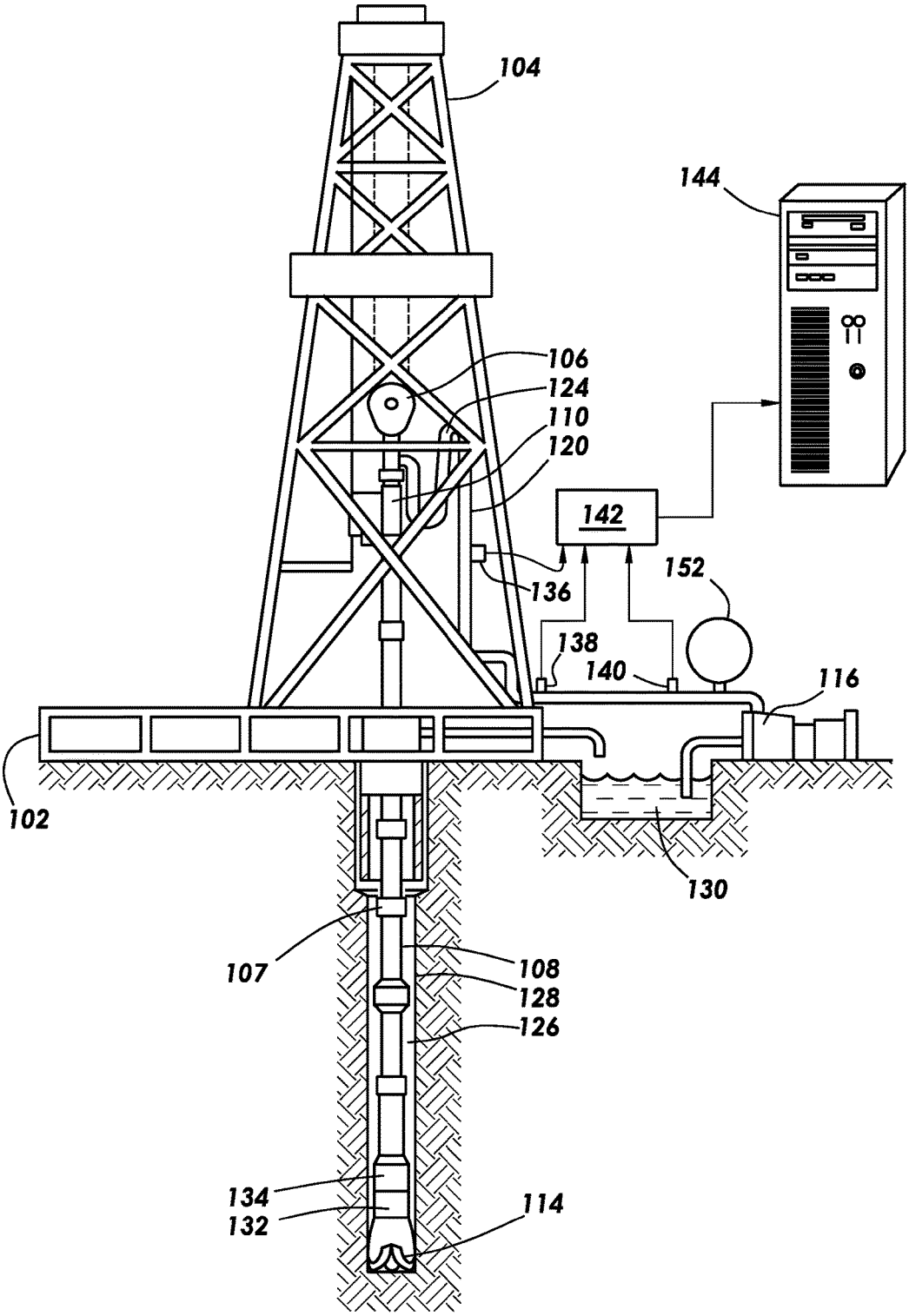
FIG. 1 shows a well during drilling operation in accordance with at least some embodiments.

Various terms are used to refer to particular system components. Different companies may refer to a component by different names—this document does not intend to distinguish between components that differ in name but not function. In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection or through an indirect connection via other devices and connections.

"About" in relation to recited quantity means the recited quantity within +/−5% (five percent).

"Bore," such as a through-bore or counter-bore, and as it relates to internal volumes of various components of a pulser system, shall not speak to the creation method of any such bore. Thus a bore may be made by boring (e.g., with a bit), and the bore may also be creating by casting the bore, or any other creation method.

"Poppet" in relation to a system for creating pressure pulses within a drill string shall mean a valve member moveable relative to a valve seat, where position of the valve member relative to the valve seat controls a majority of flow of drilling fluid within a drill string. A pilot valve that controls less than a majority of flow of drilling fluid, and is used to control position of another valve member, shall not be considered a poppet for purposes of this specification and claims.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Example embodiments are directed to measuring-while-drilling (MWD) tools, and more particularly pulser systems that create pressure pulses in the drilling fluid within the drill string. More particularly, example embodiments are directed to a pulser system as part of a measuring-while-drilling (MWD) tool that controls position of a poppet relative to a valve seat by a direct drive system, thus omitting the pilot valve and its related problems. More particularly still, example embodiments are directed to a pulser system where an electric motor, submerged in hydraulic fluid within the pulser system, turns a drive shaft. By controlling direction of rotation of the drive shaft of the motor, and number of rotations of the drive shaft, the position of the poppet of the pulser system is controlled to create positive-pressure pulses for mud-pulse telemetry. The specification first turns to a drilling system to orient the reader.

FIG. 1 shows a well during drilling operation in accordance with at least some embodiments. A drilling platform 102 includes a derrick 104 associated with a hoist 106. Drilling of hydrocarbon boreholes is carried out by a string of drill pipes connected together by "tool joints" 107 so as to form a drill string 108. In the example system, the hoist 106 suspends a top drive 110 that is used to rotate the drill string 108 as the drill string 108 is being lowered into the borehole. In other cases, the drill string 108 may be turned by drive unit on the floor of the drilling platform 102. Connected to the lower end of the drill string 108 is a drill bit 114. Drilling is accomplished by rotating the drill bit 114, either by the top drive 110 rotating the drill string 108, a downhole motor (not specifically shown) rotating the drill bit 114, or both. Drilling fluid is pumped by mud pump 116 through stand pipe 120, goose neck 124, top drive 110, and down through the drill string 108 at high pressures and volumes to emerge through nozzles or jets in the drill bit 114. The drilling fluid then travels back up the borehole via the annulus 126 formed between the exterior of the drill string 108 and the borehole wall 128, through a blowout preventer (not specifically shown), and into a mud pit 130 on the surface. On the surface, the drilling fluid is cleaned and then circulated again by mud pump 116. The drilling fluid is used to cool the drill bit 114, to carry cuttings to the surface, and to balance the hydrostatic pressure in the rock formations.

In boreholes employing mud-pulse telemetry for MWD, downhole tools 134 collect data regarding the formation properties and/or various drilling parameters. The downhole tools 134 are coupled to a pulser system 132 that transmits the data to the surface. Pulser system 132 modulates a flow resistance of drilling fluid within drill string 108 to generate pressure pulses that propagate to the surface at designated pulse widths. Transducers, such as transducers 136, 138, and 140, convert the pressure pulses into electrical signals for a signal digitizer 142 (e.g., an analog-to-digital converter). While three transducers 136, 138, and 140 are illustrated, a greater number of transducers, or fewer transducers (e.g., one transducer), may be used. The digitizer 142 supplies a digital form of the pressure pulses to a computer 144 or some other form of a data processing device. Computer 144 operates in accordance with software (which may be stored on a computer-readable storage medium) to process and decode the received pulses. The resulting telemetry data may be further analyzed and processed by computer 144 or other computer to generate a display of useful information. For example, a driller could employ computer 144 to obtain and monitor the bottom hole assembly (BHA) position and orientation information, drilling parameters, and formation properties (e.g., natural gamma).

Pulser system 132 in example systems generates positive-pressure pulses within the drill string 108. Ideally, each and every positive-pressure pulse created downhole would propagate toward the surface and be easily detected by a transducer. However, drilling fluid pressure fluctuates and contains noise from several sources (e.g., bit noise, torque noise, and mud pump noise). Bit noise is created by vibration of the drill bit during the drilling operation. As the drill bit moves and vibrates, the drilling fluid exiting nozzles or jets in the drill bit can be partially or momentarily restricted, creating a high frequency noise in the pressure pulses. Torque noise is generated downhole by the action of the drill bit sticking in a formation, causing the drill string to torque up. The subsequent release of the drill bit relieves the torque on the drill string and generates a low frequency, high amplitude pressure surge. Finally, the mud pump 116 creates cyclic noise as the positive-displacement elements (e.g., pistons) within the pump force the drilling fluid into the drill string. Some drilling systems contain a dampener 152 to reduce noise associated with these and other noise sources.

Figure 2:
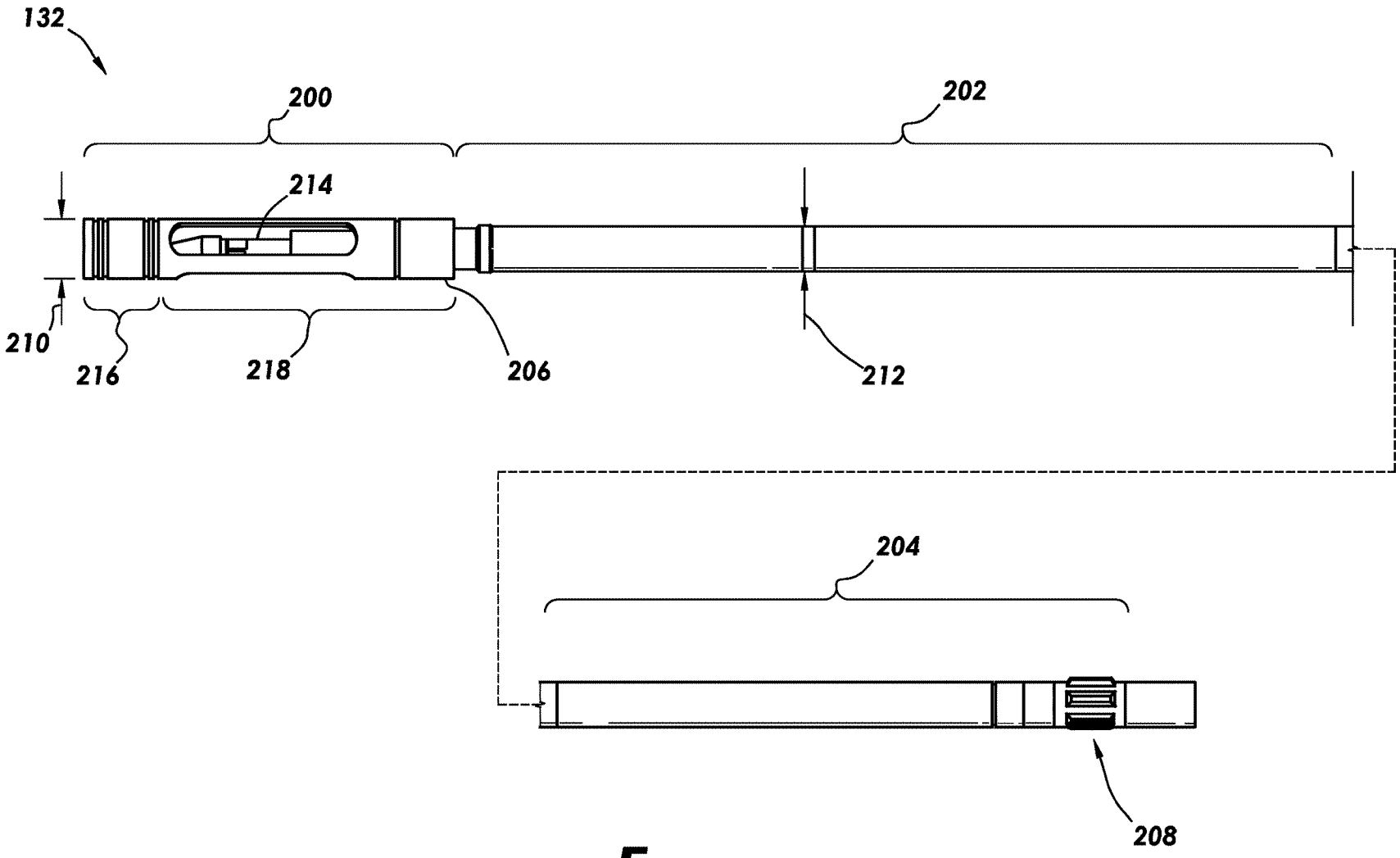
FIG. 2 shows a side elevation view of a pulser system in accordance with at least some embodiments.

FIG. 2 shows a side elevation view of a pulser system 132 in accordance with at least some embodiments. In particular, the example pulser system 132 may be conceptually, though necessarily physically, divided into a poppet assembly 200, a linear actuation assembly 202, and an electrical drive assembly 204. The example embodiments discussed are part of retrievable MWD tool, meaning that the various components of the pulser system 132 shown in FIG. 2, along with downhole tools 134 (FIG. 1), may be placed into the drill string and removed from the drill string without the need of removing the drill string from the borehole. Thus, in example embodiments the pulser system 132 may be telescoped within an internal diameter of the drill string at the surface and lowered into place. The poppet assembly 200 includes mule shoe 206 that couples to a landing sub (not specifically shown). The mule shoe 206 holds the pulser system 132 in a desired orientation within the drill string (e.g., centered within the drill string). One or more standoffs, such as standoff 208 associated with the electrical drive assembly 204, may likewise help hold the pulser system 132 in the desired orientation within the drill string. While the example pulser system 132 is thus held at opposite ends (e.g., by the mule shoe 206 on one end and the standoff 208 on the other end), additional standoffs may be included at any suitable location along the outside diameter of the pulser system 132. In yet still other embodiments, the pulser system 132 may be included as part of a non-retrievable MWD system, such that retrieving the MWD system requires tripping the entire drill string.

Whether part of a retrievable or non-retrievable MWD tool, the example pulser system 132 defines an outside diameter. In particular, the poppet assembly 200 defines an outside diameter 210, and the linear actuation assembly 202 and electrical drive assembly 204 define a second outside diameter 212. In example systems, the outside diameters 210 and 212 are smaller than an inside diameter of drill pipe within which the pulser system 132 is placed such that drilling fluid flows in the annulus between the outside diameter of the pulser systems 132 and an inside diameter of the drill pipe. More particularly, in use drilling fluid flows past the electrical drive assembly 204, then the linear actuator assembly 202, then through apertures 214 of the mule shoe 206. More particularly, mule shoe 206 has a landing zone 216 and a flow zone 218. The landing zone 216 seals against an inside diameter of the landing sub. Drilling fluid thus flows along the outside diameter of the mule shoe 206 in the flow zone 218, and then into the mule shoe 206 through one or more apertures 214. As will be discussed in greater detail below, a poppet within the poppet assembly 200 is selectively moved in relation to a valve seat within the poppet assembly to cause selective restrictions of the flow of drilling fluid, and thus pressure pulses that then propagate toward the surface (to the right in FIG. 2).

Figure 3:
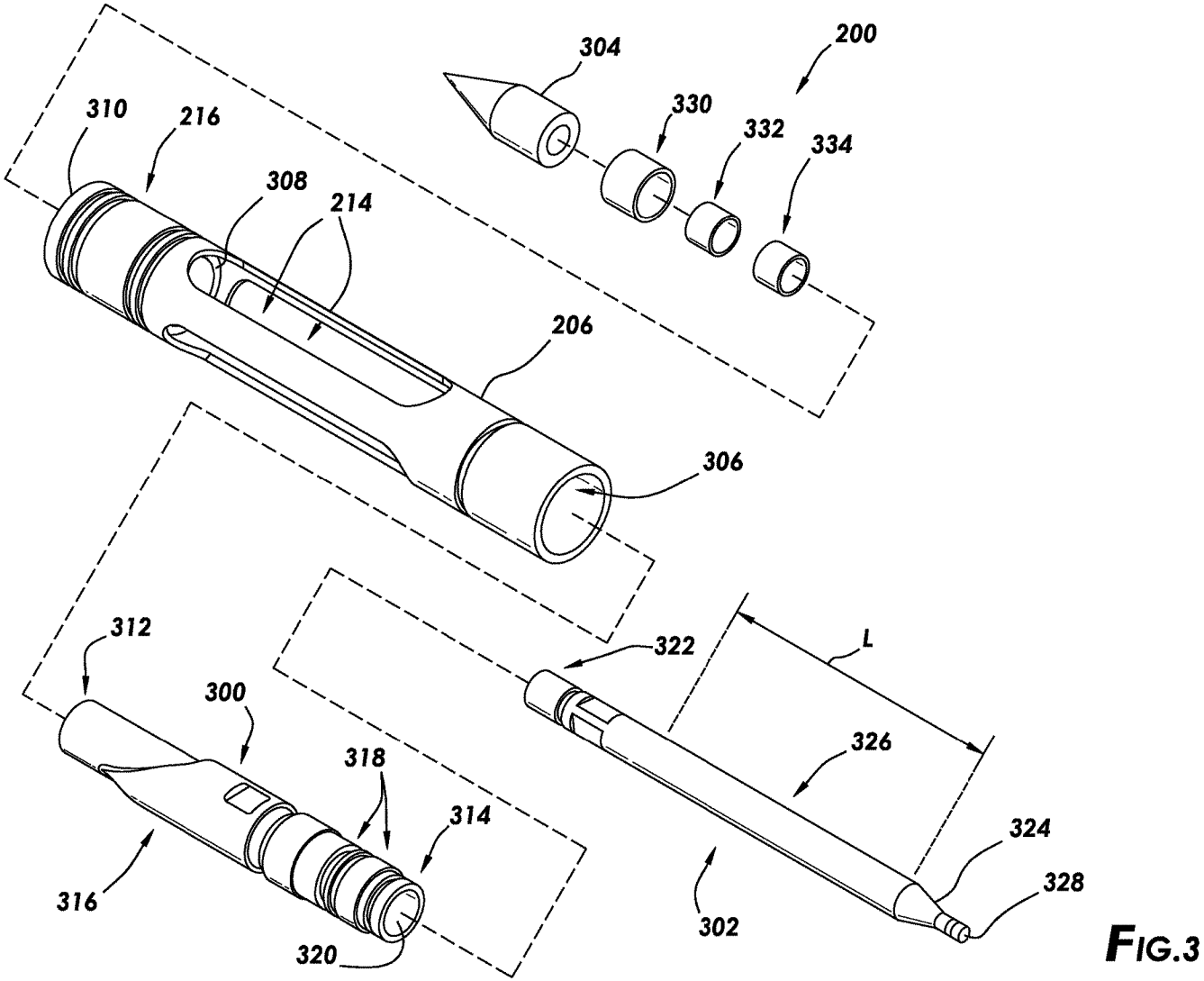
FIG. 3 shows an exploded perspective view of a poppet assembly in accordance with at least some embodiments.

FIG. 3 shows an exploded perspective view of a poppet assembly 200 in accordance with at least some embodiments. In particular, visible in FIG. 3 is the mule shoe 206, a cylinder housing 300, a hydraulic ram or piston rod 302, and a poppet 304. The mule shoe 206 includes a circular outside diameter that includes the landing zone 216 and apertures 214. The landing zone 216 defines a plurality of annular channels that circumscribe the mule shoe 206 and which, in use, house respective seals (e.g., polymeric O-rings). The example mule shoe 206 has three oblong-shaped apertures 214, but the apertures may have any suitable shape and number so long apertures enable the drilling fluid to flow from outside the mule shoe 206 to the internal volume 306. Visible through the apertures 214 is the valve seat 308. In some example embodiments the valve seat 308 is defined by a shoulder region between a larger internal diameter (e.g., at the location of the apertures 214) and a smaller internal diameter at the distal end 310 of the mule shoe 206 (e.g., at the location of the landing zone 216). In some cases the poppet (discussed more below) does not actually contact or seal against the valve seat 308; rather, the physical relationship between the valve seat 308 and the poppet define a cross-sectional area through which drilling fluid passes. Larger cross-sectional areas result in lower resistance to drilling fluid flow, and smaller cross-sectional areas result in higher resistance to drilling fluid flow.

The example poppet assembly 200 further comprises the cylinder housing 300. As shown by FIG. 3, the cylinder housing 300 telescopes within an internal diameter of the mule shoe 206. The example cylinder housing 300 defines a distal end 312 and a proximal end 314. Medially disposed along the cylinder housing 300 is a rotational alignment feature 316. The rotational alignment feature 316 interacts with a corresponding feature on an inside diameter of the mule shoe 206 to rotationally align the cylinder housing 300 (and in some cases the balance of the pulser system) relative to the mule shoe 206. Further the rotational alignment feature 316 may also hold the cylinder housing 300 (and in some cases the balance of the pulser system) against rotation relative to the drill string (not shown). That is, torque loads generated within the pulser system (e.g., such as by an electric motor, discussed more below) may exert a rotational force, but the rotational alignment feature 316 may hold the system against rotation. In the example system the rotational alignment feature 316 is in the form an increased diameter portion in shape of a tear drop, with the point of the tear drop "pointing" toward the distal end 312, and with the bulbous portion of the tear drop meeting on the opposite side the cylinder housing 300 from the point. Other rotational alignment features may be used.

The cylinder housing 300 further comprises a plurality of annular channels 318 circumscribing the outside diameter of the cylinder housing 300, the annular channels 318 closer to the proximal end 314. The annular channels 318 may facilitate connection and sealing to a barrel (discussed more below) of the linear actuation assembly 202. The cylinder housing 300 further defines an inside diameter 320. In some example embodiments the inside diameter 320 of the cylinder housing 300 is uniform over the entire length. As will be discussed more below, the inside diameter 320 works in conjunction with the piston rod 302 to form a seal that seals hydraulic fluid within the pulser system.

The cylinder housing 300, which may alternatively be referred to as a hydraulic housing, has a dual purpose. The cylinder housing 300 is used to orient the tool in the mule shoe 206 as well as being the main cylinder through which the piston rod 302 protrudes. External fluid (e.g., drilling fluid) pressure is applied on the poppet 304 that is mounted on the distal end of the piston rod 302. Through the piston rod any vibration, tension, and pressure caused by the drilling fluid are applied on the sealing mechanism between the piston rod 302 and the cylinder housing, which makes the cylinder housing 300 an important and vulnerable part of the whole system. Thus, in example embodiments the cylinder housing 300 is engineered to provide reduced friction, high quality sealing methods, and robust design to withstand the vibration, tension, and pressure of the drilling fluid. For strength and durability the cylinder housing 300 may be built from a strengthened stainless steel allow, such as NITRONIC-brand material available from AK Steel of Wes Chester Township, Ohio. The piston rod 302 may also be made from the strengthened stainless steel allow, such as NITRONIC-brand materials.

In some example embodiments, to achieve suitable sealing and yet maintain reduced friction, the example system may further rod wiper 330 and seals 332 and 334. In example systems, the rod wiper 330 may be disposed at the distal end 312 of the cylinder housing 300, and the seals 332 and 332 disposed along an inside diameter of the cylinder housing 300 at any suitable location, such as near the distal end. The various embodiments of the pulser system have an operating temperature between 0° C. and 175° C., storage temperatures down to −40° C., and an operating pressure range between 0 and 20,000 PSI. Thus, in the example embodiments the rod wiper 330 may comprise a scraper made out of ARLON® 1330 (manufactured by Greene Tweed of Houston, Tex.) and include 566 FFKM O-ring. The ARLON® 1330 lubricated PEEK reduces friction. In the example system the scraper of rod wiper 330 is not intended to form a seal; rather, the scaper reduces or prevents particulates from entering the hydraulic fluid. The scraper profile helps reject drilling mud from the internal hydraulic fluid within the pulser system.

Seals 332 and 334 in example systems use an MSE® brand assembly (manufactured by Greene Tweed) that has a scraper-style MSE® jacket made out of AVLON® 89 (manufactured by Greene Tweed), which is designed for a high dynamic application. The seals 332 and 334 have finger spring to energize the seal legs. For this is a high pressure, high cycle application, backup rings are included to reduce or prevent extrusion of the elastomer through the extrusion gap. A solid anti-extrusion ring (back up ring) made of ARLON® 1000 resists extrusion into the extrusion gap. A hat ring may be included to reduce damage to the MSE® legs, and the hat ring may be made from ARLON® 1260 (also manufactured by Greene Tweed).

Still referring to FIG. 3, the example poppet assembly 200 further comprises the piston rod 302. The piston rod 302 defines a distal end 322, a proximal end 324, and a medially disposed sealing region 326. In the example embodiments shown, the sealing region 326 is a region having an axial length L of uniform outside diameter. The sealing region 326 works in conjunction with the inside diameter of the cylinder housing 300 to form the seal to retain hydraulic fluid within the pulser system, while still enabling the piston rod 302 to move axially within the cylinder housing 300. In other cases, either the piston rod 302, the inside diameter 320 of the cylinder housing 300, or both, may comprise annular channels within which seals (e.g., polymeric O rings) may be placed to assist with the sealing process. In order to reduce friction between the piston rod 302 and the cylinder housing 300, the piston rod 302 may be high velocity oxygen fuel (HVOF) coated. Such an HVOF coating not only reduces frictions, but also increases life of the piston rod 302. The piston rod 302 and cylinder housing 300 thus form an engineered seal gland that improves durability and maintains insulation from, for example, ambient deep sea level pressure conditions and high temperature of about 200° Celcius. The proximal end 324 defines a connector 328 designed and constructed to mechanically couple to a linear positioner (discussed more below). The distal end 322 is designed and constructed to couple to the poppet 304. In example embodiments, the poppet 304 telescopes over the distal end 322 of the piston rod 302, and couples to the piston rod 302 in any suitable fashion. The specification now turns to the example linear actuation assembly 202.

Figure 4:
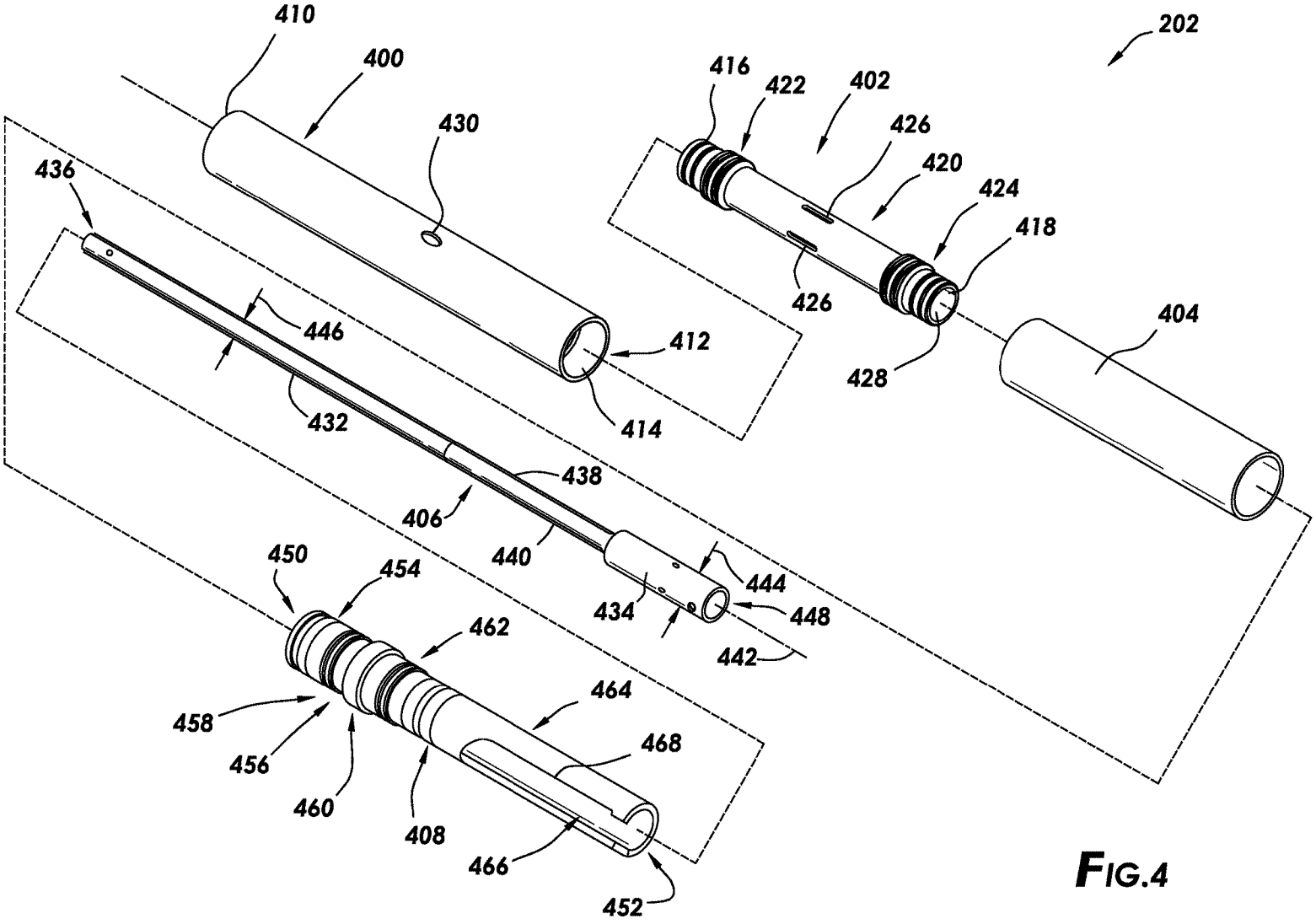
FIG. 4 shows an exploded perspective view of a first portion of a the linear actuation assembly, in accordance with at least some embodiments.

FIG. 4 shows an exploded perspective view of a first portion of the linear actuation assembly 202, in accordance with at least some embodiments. In particular, the portion of the actuation assembly 202 shown comprises actuation barrel 400, membrane support member 402, membrane 404, linear positioner 406, and transition member 408. Each will be addressed in turn. The actuation barrel 400 defines a distal end 410, a proximal end 412, and an interior volume 414. The distal end 410 is designed and constructed to telescope over, couple to, and seal to the proximal end 314 (FIG. 3) of the cylinder housing 300 (FIG. 3). Example internal components of the actuation barrel 400 are discussed in great detail below. The membrane support member 402 defines a distal end 416, a proximal end 418, and a medially disposed annular trough 420. The annular trough 420 is defined between a seal region 422 (near the distal end 416) and a seal region 424 (near the proximal end 418). The annular trough 420 includes a plurality of apertures 426 that fluidly couple the annular trough 420 to an internal volume 428 of the membrane support member 402 for purposes of pressure compensation of the pulser system. The membrane 404, in example cases a sleeve of polymeric material (e.g., Viton), telescopes over the membrane support member 402, and resides within the annular trough 420 between the seal region 422 and seal region 424. When the pulser system is assembly and filled with hydraulic fluid, the region between the outside surface of the annular trough 420 and an inside surface of the membrane 404 is exposed to the hydraulic fluid. Drilling fluid enters through aperture 430 through the actuation barrel 400, and equalizes pressure as between the drilling fluid within the drill string and the hydraulic fluid within the pulser system. The example system can provide pressure equalization for pressures of up to about 20,000 PSIA.

The linear actuation assembly 202 further comprises the linear positioner 406. The linear positioner 406 defines a rod 432 and a coupler 434. The rod defines a distal end 436 designed and constructed to couple to the connector 328 (FIG. 3) of the piston rod 302 (FIG. 3). In the example embodiment shown the rod 432 defines axial grooves 438 and 440. In particular, axial groove 438 is disposed on an outside surface of the rod 432, and the axial groove 438 runs along the outside surface of the rod 432 parallel to the central axis 442 of the linear positioner 406. The axial groove 438 may take any suitable cross-sectional shape (the cross-section perpendicular to the central axis 442), such as square, rectangular, triangular, and the like. While in some cases a single axial groove may be used, in the example shown the linear positioner 406 includes a second axial groove 440. Axial groove 440 runs along the outside surface of the rod 432 parallel to the central axis 442 of the linear positioner 406, and also parallel to the axial groove 438. The axial groove 440 may take any suitable cross-sectional shape (the cross-section perpendicular to the central axis 442), such as square, rectangular, triangular, and the like, and axial groove 440 need not have the same cross-sectional shape as axial groove 438. In some cases the rod 432 includes four axial grooves of any suitable cross-sectional shape. The rod 432 not only holds the linear positioner 406 against rotation, but also provides a path for hydraulic fluid with the linear actuation assembly to be displaced during movement of the linear positioner 406. Moreover, the axial grooves enable fluid displacement as the pressure is equalized by way of the membrane support member 402 and membrane 404.

The linear position 406 further comprises the coupler 434. Coupler 434 defines an outside diameter 444 greater than an outside diameter 446 of the rod 432. The coupler 434 defines an internal volume 448 defined by an inside diameter (e.g., a blind bore, not visible in FIG. 4). The internal volume 448 defines a region within which a threaded shaft (discussed more below) extends and retracts as the pulser system moves the poppet relative to the valve seat. In particular, the coupler 434 couples to a ball screw nut such that, as the ball screw nut translates along the threaded shaft, the ball screw nut moves the linear positioner 406. During retraction of the poppet away from the valve seat (or, alternatively, toward an electric motor), the ball screw nut moves proximally on the threaded shaft, and thus a distal portion of the threaded shaft telescopes into the internal volume 448 of the coupler 434. Oppositely, during extension of the poppet toward the valve seat (or, alternatively, away from the electric motor), the ball screw nut move distally on the threaded shaft, and the threaded shaft thus retracts from the internal volume 448 of the coupler 434.

Still referring to FIG. 4, the first portion of the linear actuation assembly 202 further comprises the transition member 408. The transition member 408 defines a distal end 450 and a proximal end 452. The distal end 450 defines a distal seal region 454 designed and constructed to couple to and seal within the proximal end 412 of the actuation barrel 400. The transition member 408 further defines an annular ridge 456 that circumscribes a central axis of the transition member 408. The annular ridge 456 thus defines a distal shoulder region 458 and a proximal shoulder region 460. When assembled, the actuation barrel 400 abuts the distal shoulder region 458. In example systems, an outside diameter of the actuation barrel 400 and an outside diameter of the annular ridge 456 are about the same. Just proximal of the annular ridge 456 resides another seal region 462 which, as is discussed more below, couples to and seals against a mechanical barrel of the second portion of the linear actuation assembly 202.

The transition member 408 further defines a translation region 464 proximal to the seal region 462. In example embodiments the translation region 464 defines an outside diameter smaller than the outside diameter of the annular ridge 456 (and smaller than an inside diameter of the mechanical barrel discussed more below). The translation region 464 also defines an internal volume 466 by way of an inside diameter. In example embodiments, the inside diameter of the translation region 464 is slightly larger than an outside diameter 444 of the coupler 434 of the linear positioner 406. As shown in FIG. 4, when assembled the linear positioner 406 telescopes through the transition member 408, and the coupler 434 resides within the translation region 464. Cutout 468 enables access to the coupler 434 for assembly and disassembly (e.g., access to set screws that couple the coupler 434 to the ball screw nut discussed more below).

Figure 5:
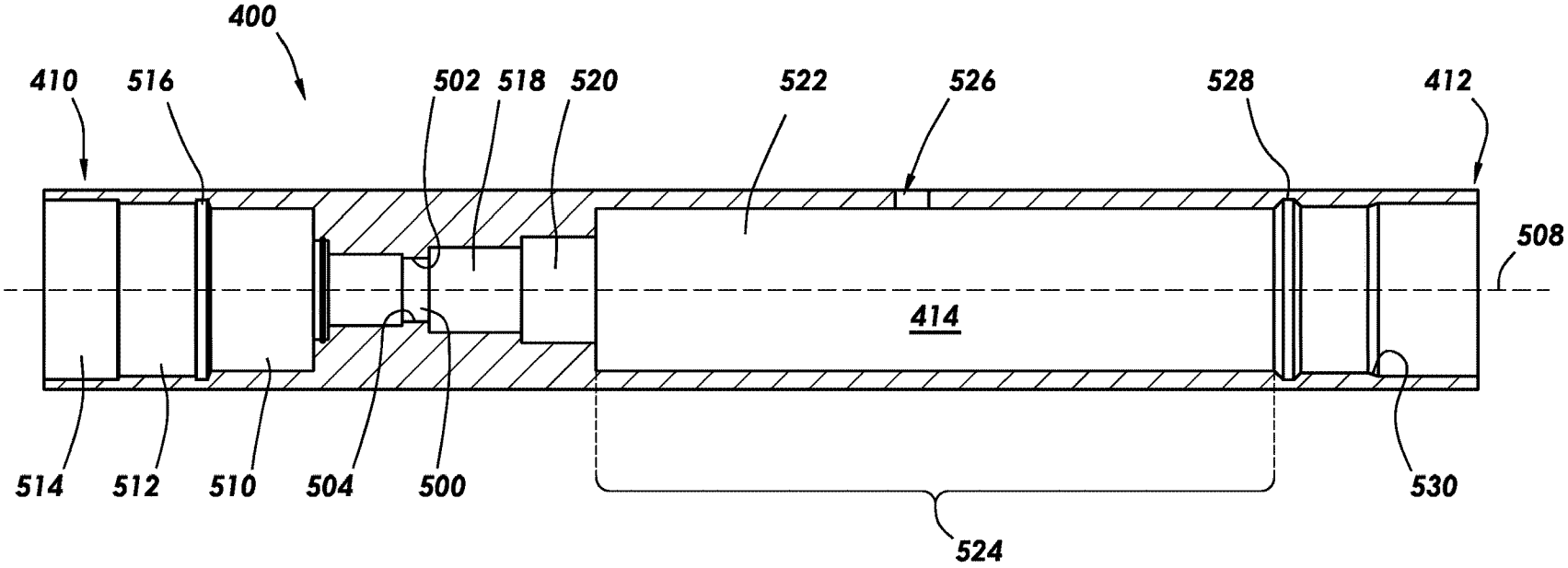
FIG. 5 shows a cross-sectional view of an actuation barrel in accordance with at least some embodiments.

FIG. 5 shows a cross-sectional view of the actuation barrel 400 in accordance with at least some embodiments. In particular, FIG. 5 shows the distal end 410 and the proximal end 412 of the actuation barrel 400. The actuation barrel 400 defines the interior volume 414 between the distal end 410 and the proximal end 412. In particular, the interior volume 414 includes through-bore 500. The through-bore 500 in example embodiments includes a first tab 502 that extends from an internal diameter of the through-bore 500 toward the central axis 508. The example through-bore 500 further comprises a second tab 504 that also extends from the internal diameter of the through-bore 500 toward the central axis 508. In some cases, and as shown, the tabs 502 and 504 are disposed at 180 radial degrees apart (e.g., on opposite sides of the internal diameter of the through-bore 500). Other arrangements of the tabs 502 and 504 are possible. In example embodiments, the tabs 502 and 504 define a cross-sectional shape that is complementary to the axial grooves 438 and 440 (FIG. 4) of the linear positioner 406. When assembled, the tabs 502 and 504 reside within the axial grooves 438 and 440, and thus serve an example purpose of the enabling translation of the linear positioner 406 relative the central axis 508, and also holding the linear positioner 406 against rotational about the central axis 508.

The internal diameter of the distal end 410 of the actuation barrel 400 defines an example set of counter bores (e.g., counter bores 510, 512, and 514). A shoulder region is defined between counter bores 514 and 512. An annular groove 516 is defined between counter bores 512 and 510. The counter bores 510, 512, and 514, along with annular groove 516, are designed and constructed to mate with and seal against the proximal end 314 (FIG. 3) of the cylinder housing 300 (FIG. 3). The internal diameter of the actuation barrel 400 further defines another example set of counter bores (e.g., counter bores 518, 520, and 522. While three counter bores are defined in the example system, and single counter bore (e.g., counter bore 522) may be used to lead to the through-bore 500. Counter bore 522 defines a region 524 within which the membrane support member 402 (FIG. 4) and membrane 404 (FIG. 4) reside when the linear actuation assembly is assembled. In particular, the seals 422 and 424 (FIG. 4) of the membrane support member 402 seal against the inside diameter of the counter bore 522. Aperture 526 provides for fluid communication with drilling fluid for pressure compensation. Finally, the proximal end 412 of the example actuation barrel 400 defines various features (e.g., annular groove 528 and shoulder 530) designed and constructed to mate with and seal to the distal end 450 of the transition member 408.

Figure 6:
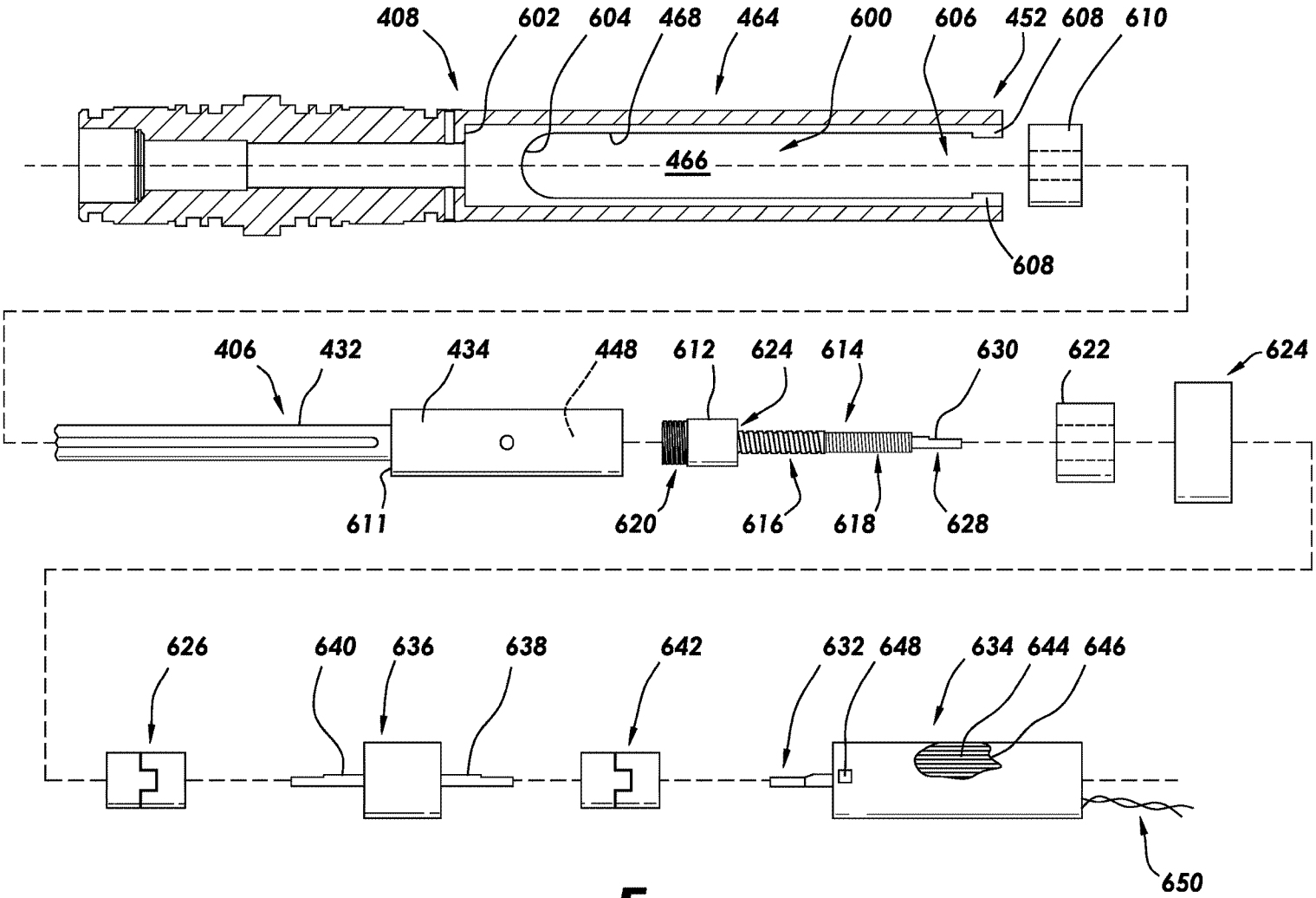
FIG. 6 shows a side elevation, exploded, and partial cross-sectional view of a second portion of the linear actuation assembly, in accordance with at least some embodiments.

FIG. 6 shows a side elevation, exploded, and partial cross-sectional view of a second portion of the linear actuation assembly, in accordance with at least some embodiments. In particular, visible in cross-section is the transition member 408 including the proximal end 452 and the translation region 464 defining the internal volume 466. The example internal volume 466 is defined by a counter bore 600 that extends from the proximal end 452 and ends at a shoulder 602. Also visible in the cross-sectional view of the transition member 408 is the cutout 468. The cutout 468 defines a distal end 604 that terminates proximally of the shoulder 602, and a proximal end 606 including tabs 608 that protrude toward each other. As will be discussed more below, in some cases the tabs 608 play a role in holding a proximal grommet in place.

The next example element in the exploded view is a distal grommet 610. The distal grommet 610 is a tube or sleeve of polymeric material (e.g., Viton) that acts as a bumper or stop for the coupler 434 of the linear positioner 406. In particular, the distal grommet 610 defines an outside diameter slightly smaller than an inside diameter of the counter bore 600, and internal aperture (shown in dashed lines). During assembly, the distal grommet 610 is telescoped within the counter bore 600 until the distal grommet 610 abuts the shoulder 602. The rod 432 of the linear positioner 406 is telescoped through the aperture through the distal grommet 610. During translation of the linear positioner 406 toward the distal end of the MWD tool (or, equivalently, away from the electric motor), a shoulder 611 defined between the rod 432 and coupler 434 of the linear positioner 406 may contact the distal grommet 610 in some situations. The distal grommet 610, being mode of a polymeric material, has a certain amount of compressibility to enable a motor controller in the electric drive assembly (discussed more below) to sense increasing torque provided by the electric motor, and stop the electric motor before damage occurs to the electric motor or other intervening components (e.g., an optional gear box). In particular, the distal grommet 610 can prevent the linear positioner from bottoming down when the linear positioner in the "zero" position. In case of obstruction in the rod travel, the motor controller can reset itself to zero position and continue the programmed cycle. The distal grommet 610 can dampen the backlash so that the unit can easily reset at a desired "zero" position.

Still referring to FIG. 6, a portion of the linear positioner 406 is shown, including the rod 432 and coupler 434. To the right of the linear positioner 406 is a ball screw nut 612 threaded over a threaded shaft 614. The example threaded shaft 614 defines two threaded regions, including a first pitch zone 616 and a second pitch zone 618. The thread pitch, and other aspects of the threads, in the first pitch zone 616 are designed and constructed to work in conjunction with the ball bearings in the ball screw nut 612. The threads in the second pitch zone 618 have a smaller pitch (e.g., smaller distance between adjacent crests of the threads measured parallel to the central axis of the threaded shaft 614). The second pitch zone 618 is designed and constructed to threadingly couple to a bearing assembly (discussed more below). The ball screw nut 612 defines external threads 620 designed and constructed to mate with internal threads of the coupler 434 (the internal threads not visible in FIG. 6). Moreover, the ball screw nut 612 defines an aperture through which the threaded shaft 614 (particularly the first pitch zone 616) may protrude depending on the axial position of the ball screw nut 612 along the threaded shaft 614. Assuming the device is assembled, in the relative orientation of the ball screw nut 612 and the threaded shaft 614 shown, the poppet 304 (FIG. 3) would be in its closest position to the valve seat 308 (FIG. 3). When the poppet 304 is withdrawn from its closest position to the valve seat 308, a portion of the first pitch zone 616 extends through the ball screw nut 612 into an internal volume 448 of the coupler 434.

Still referring to FIG. 6, the next example element is a proximal grommet 622. The proximal grommet 622 is a tube or sleeve of polymeric material that acts as a bumper or stop for the coupler 434 of the linear positioner 406 similar to the distal grommet 610, but at the opposite end of the counter bore 600 of the translation region 464. In particular, the proximal grommet 622 defines an outside diameter slightly smaller than an inside diameter of the counter bore 600, and internal aperture (shown in dashed lines). During assembly, the proximal grommet 622 is telescoped within the counter bore 600 and resides at the proximal end 452 of the translation region 464. In some cases, the proximal grommet 622 has features on an outside diameter that interacts with the tabs 608 to retain the proximal grommet 622 within the internal volume 466 of the translation region 464. Other mechanisms may be used, in addition to, or in place of, the tabs 608 to retain the proximal grommet 622 (e.g., fasteners). The threaded shaft 614 is telescoped through the aperture through the proximal grommet 622. During translation of the linear positioner 406 away from the distal end of the MWD tool (or, equivalently, toward the electric motor), a shoulder 624 defined between ball screw nut 612 and the first pitch zone 616 of the threaded shaft 614 may contact the proximal grommet 622 in some situations. The proximal grommet 622, much like the distal grommet 610, has a certain amount of compressibility to enable a motor controller in the electric drive assembly to sense increasing torque provided by the electric motor, and stop the electric motor before damage occurs to the electric motor or other intervening components (e.g., optional gear box).

The next example component is a bearing assembly 624 that couples to the second pitch zone 618 of the threaded shaft 614. As the name implies, the bearing assembly 624 holds the threaded shaft 614 centered within a mechanical barrel (not shown in FIG. 6). Any suitable bearing assembly may be used, such as a low friction ceramic bearing.

Still referring to FIG. 6, the next example component is a flex coupler 626. The flex coupler 626 couples to the proximal end of the threaded shaft 614. In the example system, the threaded shaft 614 defines a proximal zone 628 defining a flat surface 630. The proximal zone 628 telescopes into the flex coupler 626, and couples by any suitable mechanism (e.g., a set screw through the flex coupler that seats against the flat surface 630). However, any suitable coupling system may be used. In example embodiments, the flex coupler 626 dampens shock loads across the coupler, such as by having a polymeric component between two rigid components. Any suitable flex coupler may be used, and in other cases a coupler that does not have a shock reducing component may also be used.

In some cases the flex coupler 626 couples the threaded shaft 614 directly to a motor shaft 632 of an electric motor 634. However, in other cases, and as shown, a gear box 636 resides between the threaded shaft 614 and the motor shaft 632. The example gear box 636 defines an output shaft 640 and an input shaft 638. The output shaft 640 is coupled to the connection end (e.g., proximal zone 628) of the threaded shaft 614. In the example system, the connection between the output shaft 640 and the threaded shaft 614 is provided by the flex coupler 626. The input shaft 638 is coupled to the motor shaft 632. In the example system, the connection between the input shaft 638 and the motor shaft 632 is provided another flex coupler 642. The gear box 636 is configured such that rotation of the input shaft rotates the output shaft according to a gear ratio. An embodiment of the gear box 636 can be a planetary gear box. Examples can have a gear ratio in a range of about 3.7:1 to about 4:1. Having an electric motor in an approximate range of 12,000 rpm can give a gear output rotation in a range of about 3,000 rpm. Thus, one version can increase the output torque about four times while still maintaining a duty cycle of about 0.09 seconds, thereby enabling the piston rod 302 to create pressure pulses in the drilling fluid having durations of about 0.1 seconds.

Still referring to FIG. 6, the next example component is the electric motor 634. The electric motor 634 defines the motor shaft 632 as well as stator windings 644 (visible through cutout 646 to show the stator windings). In example embodiments the electric motor 634 is a brushless direct current (DC) electric motor comprising a sensor 648 in operational relationship to the motor shaft 632. The sensor 648 is configured to sense full or partial rotations of the motor shaft 632. The sensor 648 may be of any suitable type, such as a Hall-Effect sensor. The stator windings 644, as well as the sensor 648, are electrically coupled to the leads 650, and the leads 650 in turn are electrically coupled to an electric drive assembly (discussed more below). In example embodiments the electric motor 634 is a 480 Watt brushless DC electric motor with a speed range of about 9,000 RPM to about 12,000 RPM, such as a model number SDSM300 available from Standard Directional Services Ltd of Calgary, AB, Canada.

Figure 7:
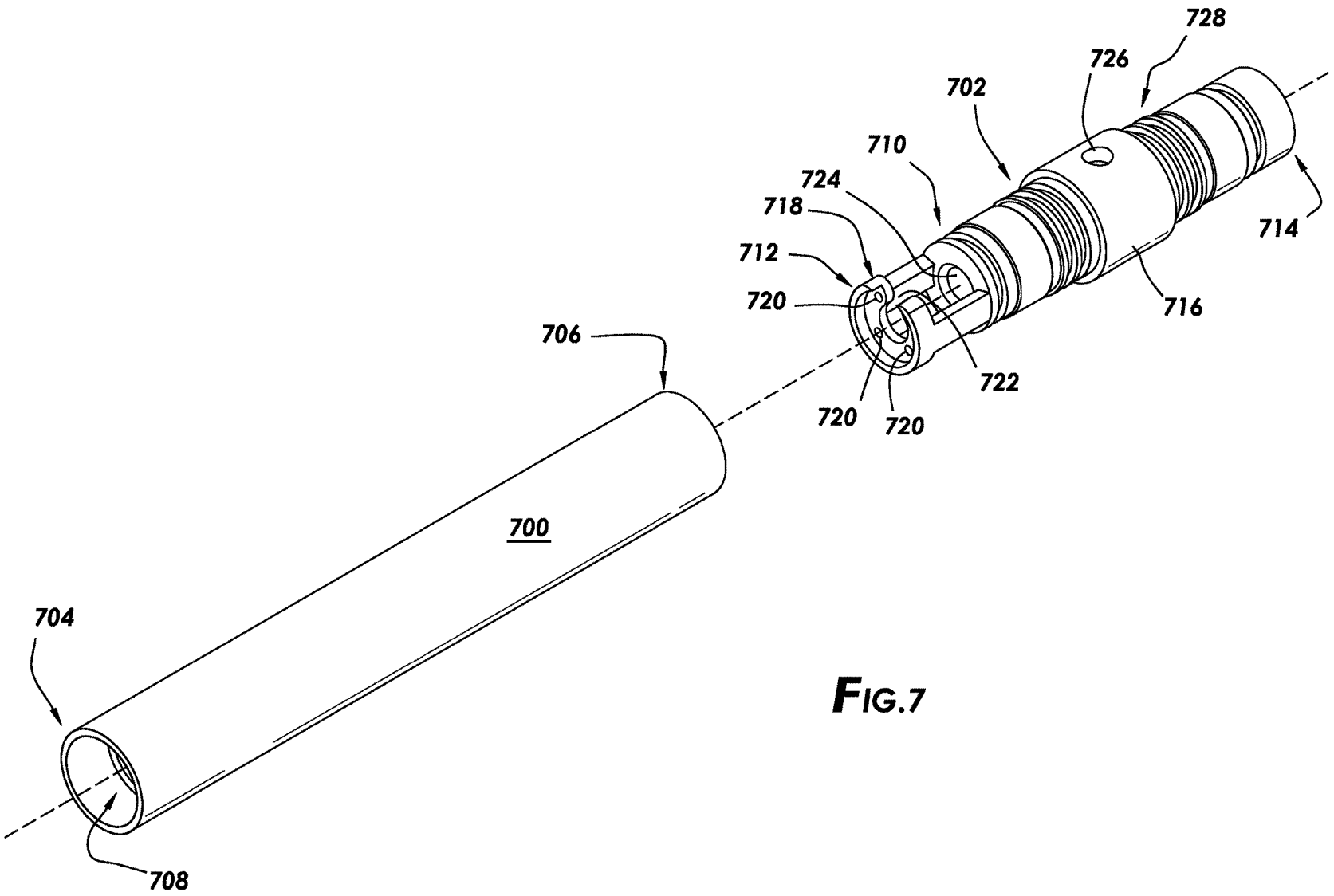
FIG. 7 shows an exploded perspective view of a second portion of the linear actuation assembly, in accordance with at least some embodiments.

FIG. 7 shows an exploded perspective view of a second portion of the linear actuation assembly, in accordance with at least some embodiments. In particular, visible in FIG. 7 is a mechanical barrel 700 and a transition housing 702. The mechanical barrel 700 defines a distal end 704 and a proximal end 706. The distal end 704 is designed and constructed to telescope over, couple to, and seal to the seal region 462 (FIG. 4) of the transition member 408 (FIG. 4). The proximal end 706 is designed and constructed to telescope over, couple to, and seal to a seal region 710 of the transition housing 702. Thus, all the components shown in FIG. 6 are disposed within an internal volume 708 of the mechanical barrel 700.

The transition housing 702 defines a distal end 712, a proximal end 714, and a medial portion 716. The distal end 712 defines a motor coupler 718 designed and constructed to mechanically couple to a proximal end of the electric motor 634 (FIG. 6). For example, an outer housing of the electric motor 634 may be rigidly coupled to the motor coupler 718 by way of fasteners that telescope through apertures 720. The example motor coupler 718 defines an opening 722 such that the motor coupler 718 defines a "U" shape. The opening 722 is provided to enable placing the leads 650 (FIG. 6) of the electric motor into the aperture 724 (to be passed through to the electric drive assembly 204 (FIG. 2)). The medial portion 716 defines an outside diameter that is about the same as an outside diameter mechanical barrel 700, and may include a fill port 726 to aid in filling the linear actuation assembly 202 (FIG. 2) with hydraulic fluid. The proximal end 714 of the transition housing 702 defines a plurality of annular channels 728 to enable coupling to and sealing against an electrical barrel (discussed more below).

In accordance with example embodiment, the linear actuation assembly 202, from the seal created by the piston rod 302 (FIG. 3) disposed within the cylinder housing 300 (FIG. 3) to the seal created between an inside diameter of the mechanical barrel 700 (FIG. 7) against the seal region 710 (FIG. 7) is filled with hydraulic fluid. That is, all the components within the linear actuation assembly 202 are submerged in the hydraulic fluid, including the linear positioner 406 (FIG. 4), the ball screw nut 612 (FIG. 6), the threaded shaft 614 (FIG. 6), the bearing assembly 624, the optional gear box 636 (FIG. 6), and the electric motor 634 (including the motor shaft 632 and stator windings 644 (FIG. 6)). Displacing all the air within the hydraulic oil of the linear actuation assembly 202 reduces the possibility of air lock. The hydraulic oil serves to cool and lubricate the various components, as well as assist in pressure equalization when the various components are disposed within a borehole, where ambient pressure can be 20,000 PSI or more. In addition, a de-airing process can be applied using an oil de-airing machine for extracting air bubbles and dissolved air from the hydraulic fluid. The oil de-airing process can be beneficial in increasing the oil bulk factor and subsequently increasing its resistance to volume changes due to high pressure exposure at extreme depths and high temperatures. The hydraulic fluid may have several characteristics, for example: low moisture content to reduce corrosion, icing and thermal expansion; low carbon residue to reduce the tendency to form carbon deposits; low viscosity index (e.g., under 10); in some cases ISO Grade 32 oil with viscosity index of 7; flash point greater than 150 degrees C.

Returning briefly to FIG. 2. The specification to this point has discussed example embodiments of the poppet assembly 200 and linear actuation assembly 202. The specification now turns to the electrical drive assembly 204.

Figure 8:
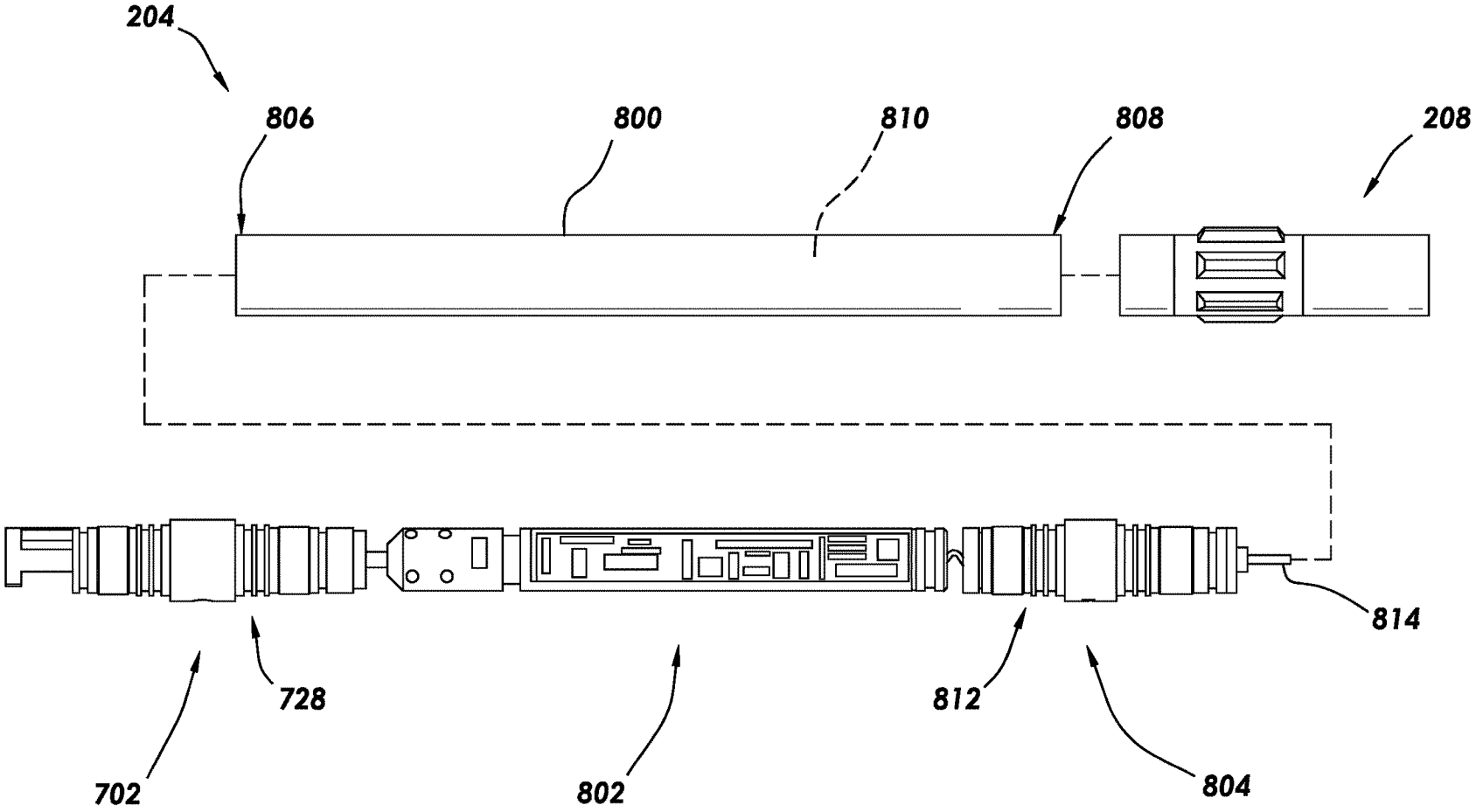
FIG. 8 shows a disassembled side elevation view of an electric drive assembly in accordance with at least some embodiments.

FIG. 8 shows a disassembled side elevation view of an electrical drive assembly 204 in accordance with at least some embodiments. In particular, visible in FIG. 8 is the transition housing 702, an electrical barrel 800, a motor controller 802, a connector housing 804, and the standoff 208. The transition housing 702 again defines annular channels 728. The electrical barrel 800 defines a distal end 806, a proximal end 808, and an internal volume 810. The distal end 806 is designed and constructed to telescope over, couple to, and seal to the annular channels 728 of the transition housing 702. The proximal end 808 is designed and constructed to telescope over, couple to, and seal to a seal region 812 of the connector housing 804. When assembled, the motor controller 802 is disposed within the internal volume 810 of the electrical barrel 800. Finally, the example electrical drive assembly 204 comprises an electrical/optical connector 814 disposed at the proximal end of the connector housing 804. The connector 814 enables the pulser system 132 (FIG. 1) to couple to various other devices and systems, such as a battery barrel containing downhole batteries, as well as various measurement systems. The connector 814 may be a 10 pin rotary connector. The motor controller 802 may derive operational power through the connector 814 (e.g., from high power 28 Volt DC lithium battery cells (not shown)). Moreover, the motor controller may receive data over the connector 814, and based on the data drive the pulser system 132 to create pressure pulses in the drill string that propagate to the surface. The example motor controller 802 may take any suitable form depending on the characteristics of the electric motor 634 (FIG. 6).

Referring simultaneously to FIG. 3-8. Example embodiments thus include moving the poppet 304 of the pulser system 132 within a MWD tool. The moving of the poppet may include activating, by the motor controller 802, the electric motor 634 and thereby turning a motor shaft 632. The turning motor shaft 632 either directly, or through the optional gear box 636, turns the threaded shaft 614. Turning of the threaded shaft 614 translates the ball screw nut 612 along the threaded shaft 614. The ball screw nut 612 is rigidly coupled to the linear positioner 406, and more particularly the coupler 434. Translation of the ball screw nut 612 translates linear positioner 406, and translation of the linear positioner 406 in turn translates the piston rod 302 within the cylinder housing 300. Thus, the poppet 304, coupled to the piston rod 302, moves relative to the valve seat 308. In a first rotational turning direction of the motor shaft 632, the poppet 304 is translated toward the valve seat 308, thus decreasing the cross-sectional flow area for drilling fluid within the drill string, and creating a positive pressure pulse. In a second rotational turning direction of the motor shaft 632 opposite the first rotational turning direction, the poppet 304 is translated away from the valve seat 308, thus increasing the cross-sectional flow area for drilling fluid within the drill string and returning the pressure within the drilling to pre-pulse pressure.

The linear actuation assembly 202 is filled with hydraulic fluid prior to the pulser system 132 being located within a borehole. Activating the electric motor 634 means the activation takes place with the motor shaft (e.g., rotor) and stator (e.g., stator windings 644) of the electric motor 634, along with the ball screw nut 612, linear positioner 406, and other components all submerged in the hydraulic fluid and sealed with the linear actuation assembly 202.

In order to control position of the poppet 304 relative to the valve seat 308, the motor controller 802 counts, during the activation of the electric motor 634, pulses from the sensor 648 that senses full or partial rotations of the motor shaft 632, the counting creates a pulse count value. The motor controller 802 may cease activation of the electric motor 643 when the pulse count value meets or exceeds a set point pulse count value proportional to a predetermined travel distance of the poppet.

The example electric motor 634 and remaining components thus provide the energy to move the poppet 304 both toward and away from the valve seat 308. In the example embodiments, moving the poppet 304 toward the valve seat 308 is without mechanical assistance of a spring. Similarly, in some embodiments moving the poppet 304 away from the valve seat 308 is without mechanical assistance of a spring. More particular, in example embodiment the poppet 304 is moved toward the valve seat 308 without a spring providing a force parallel to a central axis of the threaded shaft 614. Similarly, in some embodiments the poppet 304 is moved away from the valve seat 308 without a spring providing a force parallel to the central axis of the threaded shaft 614.

Figure 9:
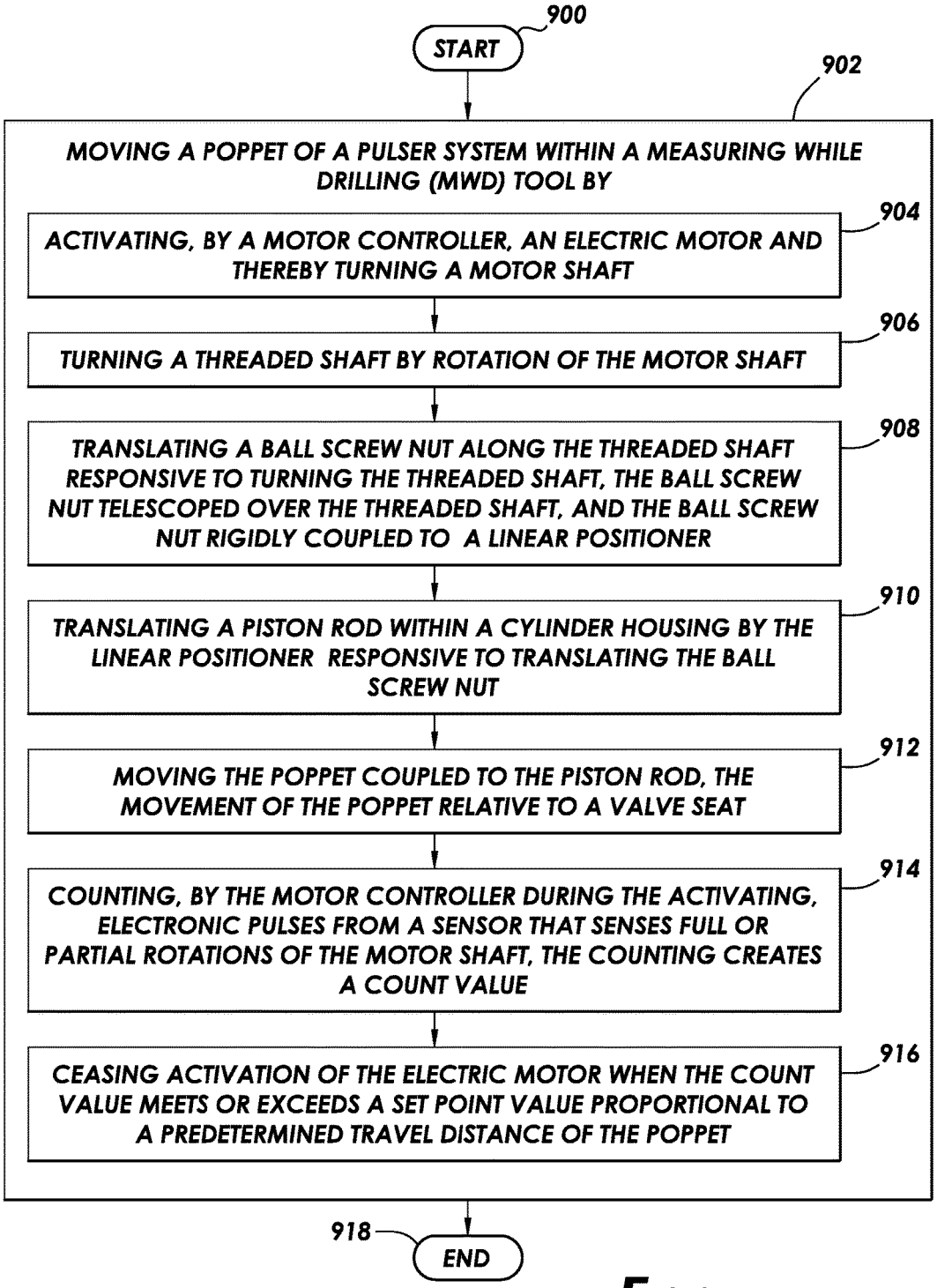
FIG. 9 shows a method of creating pressure pulses within a drill string during drilling operations, in accordance with at least some embodiments.

FIG. 9 shows a method of creating pressure pulses within a drill string during drilling operations, in accordance with at least some embodiments. In particular, the method starts (block 900) and comprises moving a poppet of a pulser system within a measuring while drilling (MWD) tool (block 902). Moving the poppet may comprise: activating, by a motor controller, an electric motor and thereby turning a motor shaft (block 904); turning a threaded shaft by rotation of the motor shaft (block 906); translating a ball screw nut along the threaded shaft responsive to turning the threaded shaft, the ball screw nut telescoped over the threaded shaft, and the ball screw nut rigidly coupled to a linear positioner (block 908); translating a piston rod within a cylinder housing by the linear positioner responsive to translating the ball screw nut (block 910); moving the poppet coupled to the piston rod, the movement of the poppet relative to a valve seat (block 912); counting, by the motor controller during the activating, electronic pulses from a sensor that senses full or partial rotations of the motor shaft, the counting creates a count value (block 914); and ceasing activation of the electric motor when the count value meets or exceeds a set point pulse value proportional to a predetermined travel distance of the poppet (block 916). Thereafter the method ends (block 918), likely to be restarted to move the poppet in an opposite direction.

The pulser system 132 in example embodiments may have a data rate of 10 pulses per second (PPS) (e.g., pulse durations of 0.1 second) in some cases. In other cases the pulser system 132 may have pulse durations of 0.250 seconds (4 PPS) and/or 0.375 seconds. In some case the data rate and/or pulse duration may be selectable by way of messages transmitted from the surface. In some cases the selection may be from a set of four pulse duration modes (e.g., 0.8 second, 0.5 seconds, 0.375 seconds, and 0.250 seconds). The pulse amplitudes that the example system may create include 50 PSI to 250 PSI, and in some cases about 100 PSI. Any suitable encoding scheme may used, such as pulse-position encoding, pulse amplitude encoding, and combinations thereof.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A method of creating pressure pulses within a drill string during drilling operations, the method comprising:

moving a poppet of a pulser system within a measuring while drilling (MWD) tool, the moving of the poppet by:

activating, by a motor controller, an electric motor with a stator submerged in hydraulic fluid, and thereby turning a motor shaft;

turning a threaded shaft by rotation of the motor shaft;

translating a ball screw nut along the threaded shaft responsive to turning the threaded shaft the ball screw nut telescoped over the threaded shaft and the ball screw nut rigidly coupled to a linear positioner;

translating a piston rod within a cylinder housing by the linear positioner responsive to translating the ball screw nut; and thereby moving the poppet coupled to the piston rod, the movement of the poppet relative to a valve seat;

counting, by the motor controller during the activating, electronic pulses from a sensor that senses full or partial rotations of the motor shaft, the counting creates a count value; and ceasing activation of the electric motor when the count value meets or exceeds a set point count value proportional to a predetermined travel distance of the poppet;

wherein the electric motor, the ball screw nut, and the linear positioner all fluidly sealed within a linear actuation assembly of the pulser system.

2. The method of claim 1 further comprising equalizing pressure as between the hydraulic fluid within the pulser system and drilling fluid within the drill string outside the pulser system.

3. The method of claim 1 wherein counting electronic pulses from the sensor further comprises counting pulses from a Hall-Effect sensor in operational relationship to the motor shaft and submerged in the hydraulic fluid.

4. The method of claim 1 wherein activating the electric motor further comprises activing by the motor controller disposed within an electrical drive assembly, the electrical drive assembly fluidly sealed from the hydraulic fluid.

5. The method of claim 1 wherein translating the ball screw nut further comprises limiting travel of the ball screw nut within an inside diameter of barrel by way of one or more grommets.

6. The method of claim 1 wherein turning the threaded shaft over which the ball screw nut is coupled further comprises:

turning, by the motor shaft, an input shaft of a gear box and thereby turning an output shaft of the gear box; and turning, by the output shaft of the gear box, the threaded shaft.

7. The method of claim 1 wherein moving the poppet relative to the valve seat further comprises:

moving the poppet toward the valve seat without mechanical assistance of a spring; and then moving the poppet away from the valve seat without mechanical assistance of a spring.

8. The method of claim 1 wherein moving the poppet relative to the valve seat further comprises:

moving the poppet toward the valve seat without a spring providing a force parallel to a central axis of the threaded shaft; and moving the poppet away from the valve seat without a spring providing a force parallel to the central axis of the threaded shaft.

9. A method of creatin pressure pulses within a drill string during drilling operations, the method comprising:

moving a poppet of a pulser system within a measuring while drilling (MWD) tool, the moving of the poppet by:

activating, by a motor controller, an electric motor comprising a brushless direct current (DC) motor with a stator submerged in hydraulic fluid, and thereby turning a motor shaft;

turning a threaded shaft by rotation of the motor shaft;

translating a ball screw nut along the threaded shaft responsive to turning the threaded shaft, the ball screw nut telescoped over the threaded shaft, and the ball screw nut rigidly coupled to a linear positioner;

translating a piston rod within a cylinder housing by the linear positioner responsive to translating the ball screw nut; and thereby moving the poppet coupled to the piston rod, the movement of the poppet relative to a valve seat;

counting, by the motor controller during the activating, electronic pulses from a sensor that senses full or partial rotations of the motor shaft, the counting creates a count value; and ceasing activation of the electric motor when the count value meets or exceeds a set point count value proportional to a predetermined travel distance of the poppet;

wherein the brushless DC motor, the ball screw nut, and the linear positioner all fluidly sealed within a linear actuation assembly of the pulser system.

10. The method of claim 9 wherein counting electronic pulses from the sensor further comprises counting electronic pulses from a Hall-Effect sensor in operational relationship to the motor shaft and submerged in the hydraulic fluid.

11. A pulser system for a measuring-while-drilling (MWD) tool, the pulser system comprising:

a poppet assembly comprising:

a poppet;

a piston rod defining a first end and a second end, the first end coupled to the poppet;

a cylinder housing defining an internal diameter, the second end of the piston rod telescoped within the internal diameter of the cylinder housing, and the cylinder housing and second end of the piston rod form a first seal;

a linear actuator assembly comprising:

a barrel defining an inside diameter, a first end, and a second end, the first end of the barrel coupled to the cylinder housing;

hydraulic fluid within the inside diameter of the barrel between the first seal and a second seal on the second end of the barrel;

a linear positioner defining a first end and a second end, the first end of the linear positioner coupled to the second end of the piston rod, and the linear positioner submerged in the hydraulic fluid;

a ball screw nut coupled to the second end of the linear positioner and submerged in the hydraulic fluid;

a threaded shaft submerged in the hydraulic fluid, the threaded shaft threaded through the ball screw nut; and an electric motor defining a motor shaft and stator windings submerged in the hydraulic fluid, the motor shaft coupled to a connection end of the threaded shaft;

an electric drive assembly comprising:

a motor controller electrically coupled to the stator windings;

the motor controller configured to move the poppet relative to the electric motor by selectively activating the motor shaft to turn in either a first direction or a second direction.

12. The pulser system of claim 11 wherein the electric motor further comprises a brushless direct current (DC) electric motor comprising a sensor in operational relationship to the motor shaft, and wherein the sensor is submerged in the hydraulic fluid and configured to sense full or partial rotations of the motor shaft.

13. The pulser system of claim 12 wherein the sensor is a Hall-Effect sensor.

14. The pulser system of claim 11:

wherein the electric motor further comprises a sensor in operational relationship to the motor shaft, the sensor configured to sense full or partial rotational of the motor shaft;

wherein the motor controller is electrically coupled to the sensor, and the motor controller is further configured to position the poppet relative to the electric motor by counting electronic pulses from the sensor.

15. The pulser system of claim 11 further comprising a grommet coupled to the linear positioner, the grommet configured to limit travel of the linear positioner and the ball screw nut.

16. The pulser system of claim 11 further comprising a gear box defining an output shaft and an input shaft, the output shaft coupled to the connection end of the threaded shaft and the input shaft coupled to the motor shaft, the gear box configured such that rotation of the input shaft rotates the output shaft according to a gear ratio.

17. The pulser system of claim 11 wherein the linear actuator assembly does not include a spring that compresses as the poppet moves away from the electric motor.

18. The pulser system of claim 11 wherein the linear actuator assembly does not include a spring that compresses as the poppet moves toward the electric motor.

* * * * *